US008376155B1

(12) United States Patent
Olko et al.

(10) Patent No.: US 8,376,155 B1
(45) Date of Patent: Feb. 19, 2013

(54) HINGEDLY ADJUSTABLE TWO SIDED STORAGE DEVICE

(76) Inventors: Henry Olko, New York, NY (US); Marie W. Olko, New York, NY (US)

( * ) Notice: Subject to any disclaimer, the term of this patent is extended or adjusted under 35 U.S.C. 154(b) by 0 days.

(21) Appl. No.: 13/271,355

(22) Filed: Oct. 12, 2011

(51) Int. Cl.
*A47F 5/08* (2006.01)
*E04G 3/20* (2006.01)

(52) U.S. Cl. ..... 211/169; 211/113; 248/221.11; 248/240.4

(58) Field of Classification Search ..... 211/58, 211/96, 97, 104, 113, 115, 116, 117, 118, 211/119, 119.004, 163, 165, 168, 169, 169.1, 211/4, 47, 70; 248/240, 240.4, 220.22, 221.11
See application file for complete search history.

(56) References Cited

U.S. PATENT DOCUMENTS

| | | | | | |
|---|---|---|---|---|---|
| 359,022 | A * | 3/1887 | Marsh | 211/96 |
| 407,560 | A * | 7/1889 | Wilson et al. | 211/67 |
| 1,526,916 | A * | 2/1925 | Kyde | 211/96 |
| 1,569,365 | A * | 1/1926 | Goldberg | 211/163 |
| 2,962,169 | A * | 11/1960 | Landsman | 211/117 |
| 3,420,381 | A * | 1/1969 | Bradfield | 211/26 |
| 3,468,429 | A * | 9/1969 | Drake | 211/169 |
| 3,664,514 | A * | 5/1972 | Drake | 211/169 |
| 3,792,777 | A * | 2/1974 | Drake | 211/169 |
| 4,006,826 | A * | 2/1977 | Rich | 211/101 |
| 4,378,070 | A * | 3/1983 | Matheis | 211/119.004 |
| 5,058,846 | A * | 10/1991 | Close | 248/284.1 |
| 5,540,339 | A * | 7/1996 | Lerman | 211/26 |
| 5,649,631 | A * | 7/1997 | Loflin | 211/44 |
| 5,782,366 | A * | 7/1998 | Garza, Jr. | 211/41.12 |
| 5,971,170 | A * | 10/1999 | Livingston | 211/116 |
| 6,340,092 | B1 * | 1/2002 | McGrath, Jr. | 211/169 |
| 6,547,087 | B2 * | 4/2003 | Accatino | 211/169 |
| 7,624,880 | B2 * | 12/2009 | Kin et al. | 211/45 |
| 8,061,789 | B2 * | 11/2011 | Krueger | 312/248 |
| 2009/0078664 | A1 * | 3/2009 | Steffan | 211/153 |

FOREIGN PATENT DOCUMENTS

JP 03277310 A * 12/1991

* cited by examiner

*Primary Examiner* — Jonathan Liu
*Assistant Examiner* — Joshua Rodden
(74) *Attorney, Agent, or Firm* — Bay State IP, LLC

(57) ABSTRACT

A hingedly adjustable two-sided storage system and device having a front and back portion that may be secured to a fixed structure through a plurality of adjustable attachment mechanisms to allow a user to access both portions during operation and configure the storage device with a plurality of attachment hangers and components.

12 Claims, 5 Drawing Sheets

HINGEDLY ADJUSTABLE TWO SIDED STORAGE DEVICE

BACKGROUND OF THE INVENTION

1. Field of the Invention

This invention relates generally to storage devices and more particularly to a hingedly adjustable two sided storage system and device that may be secured to a fixed structure through the use of adjustable attachment mechanisms.

2. Description of the Related Art

Currently, systems for closet door storage or other fixed surfaces only use one side for storage and are door or wall attached or door hanging. Usual door openings, specifically wall and wood trim allow for approximately four inches of "free space", adequate for limited two sided use. However, as known in the art, closets differ in both depth and usage, thereby allowing for the possibility of greater "free space". As such, adjustable hinges and latches would further expand two sided storage capabilities.

SUMMARY OF THE INVENTION

The instant invention, as illustrated herein, is clearly not anticipated, rendered obvious or even present in any of the prior art mechanisms, either alone or in any combination thereof.

According to one aspect of the device, a two-sided door storage device is disclosed, wherein the storage device is preferably secured to a fixed structure such as a wall or door through the use of a plurality of adjustable attachment mechanisms, in order to allow for a user to access both a front and back portion of the storage device. A user of the storage device is easily able to configure the storage device by adding a plurality of optional attachment components to meet an individual user's needs. Furthermore, the storage device utilizes the "free space" that exists between usual door openings, while correspondingly allowing for the type of storage space required while being in a hinge controlled environment. As such, if there is limited "free space" available, a user may adjust the attachment mechanisms to compensate for the limited "free space" and selectively place less bulky items for storage.

There has thus been outlined, rather broadly, the more important features of a hingedly adjustable two-sided storage device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the device in detail, it is to be understood that the device is not limited in its application to the details of construction and to the arrangements of the components set forth in the following description or illustrated in the drawings. The device is capable of other embodiments and of being practiced and carried out in various ways. Also, it is to be understood that the phraseology and terminology employed herein are for the purpose of description and should not be regarded as limiting.

These together with other objects of the device, along with the various features of novelty, which characterize the device, are pointed out with particularity in the claims annexed to and forming a part of this disclosure. For a better understanding of the device, its operating advantages and the specific objects attained by its uses, reference should be made to the accompanying drawings and descriptive matter in which there are illustrated preferred embodiments of the device.

DETAILED DESCRIPTION OF THE PREFERRED EMBODIMENT

The detailed description set forth below in connection with the appended drawings is intended as a description of presently preferred embodiments of the device and does not represent the only forms in which the present device may be constructed and/or utilized. The description sets forth the functions and the sequence of steps for constructing and operating the device in connection with the illustrated embodiments.

Figure 1A:
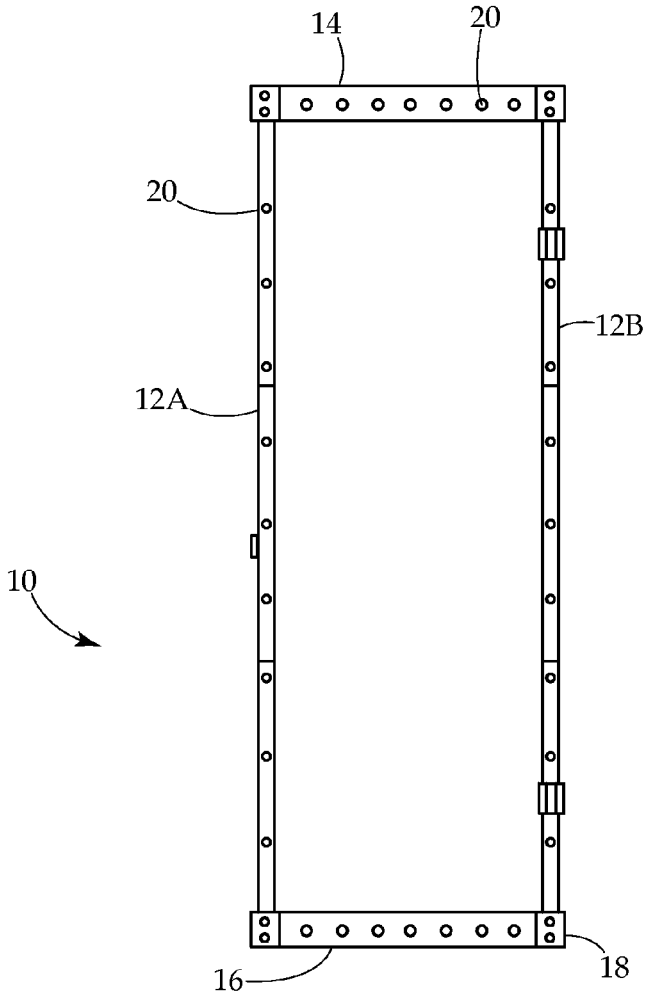
FIG. 1A illustrates a front view of a hingedly adjustable two sided storage device having a pair of lateral elements joined to a top and a bottom portion.
Figure 1B:
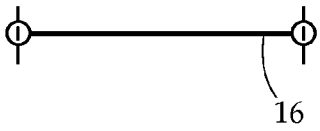
FIG. 1B illustrates a plan view of a top portion and a bottom portion joined by the pair of lateral elements.
Figure 2:
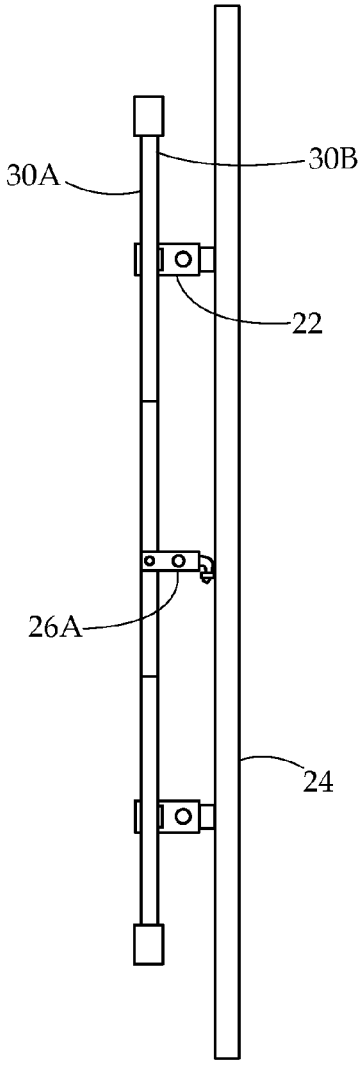
FIG. 2 illustrates a side view of the storage device in communication with a fixed structured through a plurality of attachment mechanisms.
Figure 3A:
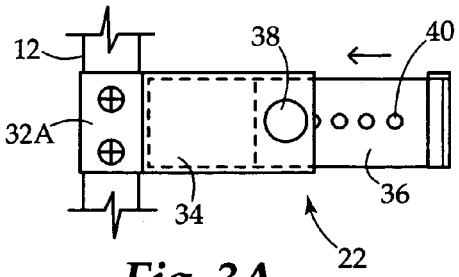
FIG. 3A illustrates an attachment mechanism to secure the storage device to a fixed structure.
Figure 3B:
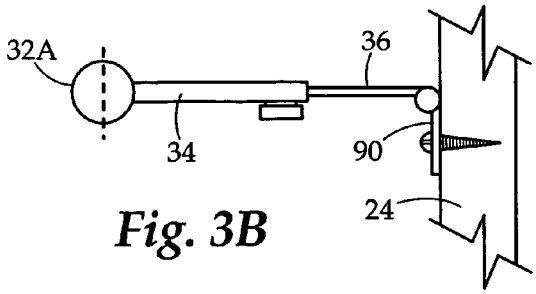
FIG. 3B illustrates a plan view of FIG. 3A.
Figure 3C:
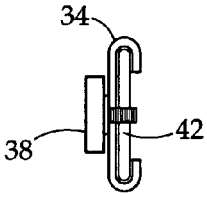
FIG. 3C illustrates a section of the holding mechanism shown in FIGS. 3A and 3B.
Figure 3D:
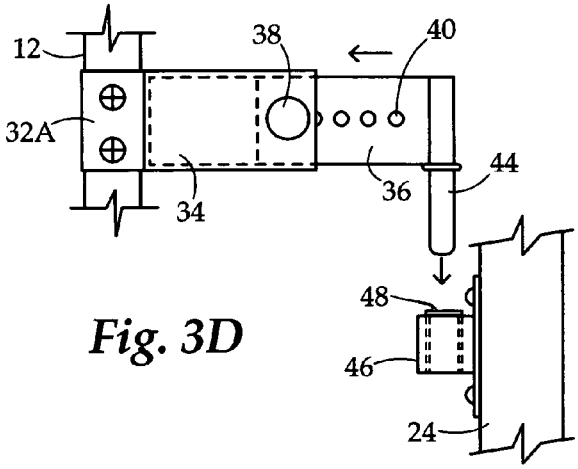
FIG. 3D illustrates an alternate embodiment of the attachment mechanism to secure the storage device to a fixed structure.
Figure 4A:
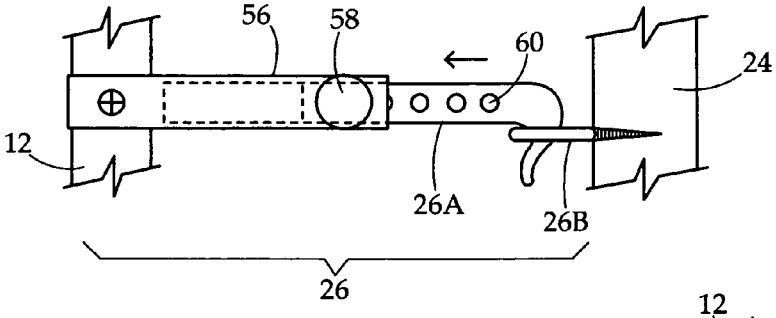
FIG. 4A illustrates a latch mechanism to secure the storage device to the fixed structure in addition to the attachment mechanisms.
Figure 4B:
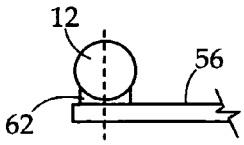
FIG. 4B illustrates a plan view of the attachment mechanism of FIG. 4A in connection with one of the lateral elements.
Figure 4C:
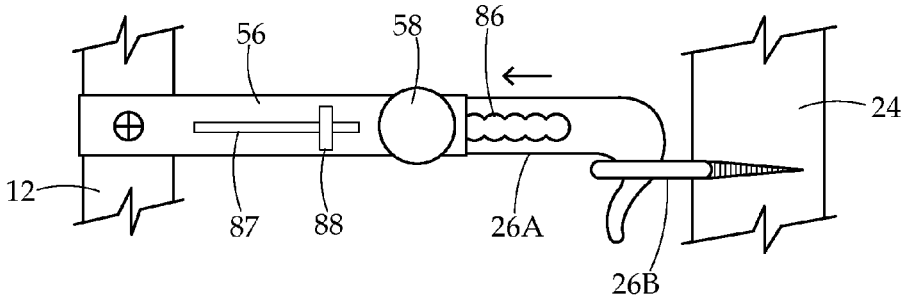
FIG. 4C illustrates a latch mechanism to secure the storage device to the fixed structure in addition and to complement the attachment mechanisms.
Figure 4D:
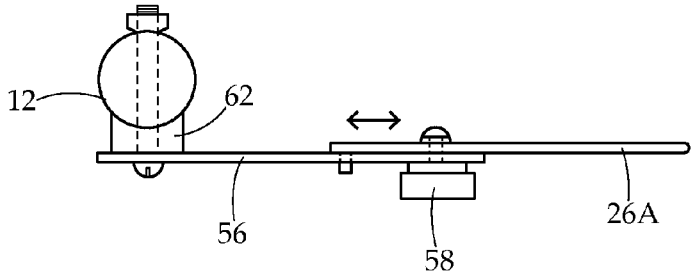
FIG. 4D illustrates a plan view of the attachment mechanism of FIG. 4C in connection with one of the lateral elements.
Figure 4E:
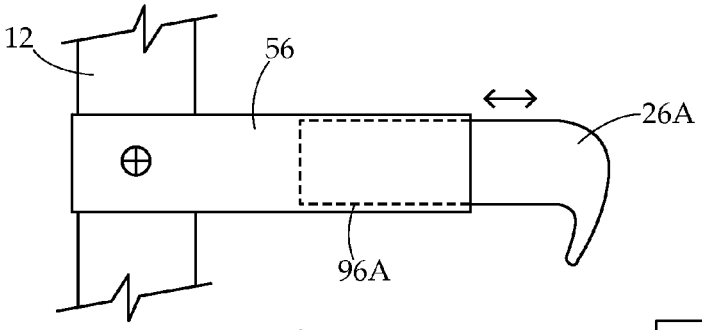
FIG. 4E illustrates an alternate embodiment of the latch mechanism to secure the storage device to the fixed structure.
Figure 4F:
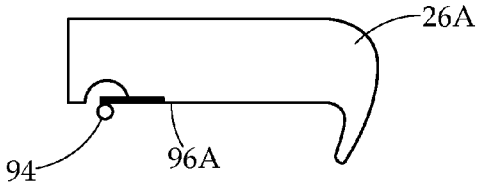
FIG. 4F illustrates a button position arm contained within the latch mechanism sleeve of FIG. 4E.
Figure 4G:
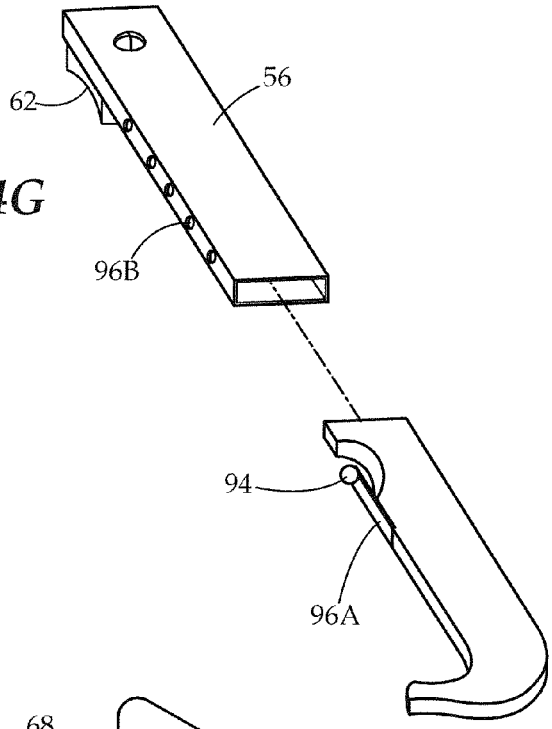
FIG. 4G illustrates a three dimensional view of the latch mechanism shown in FIG. 4E.
Figure 4H:
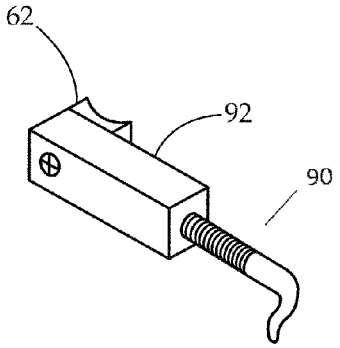
FIG. 4H illustrates an alternate embodiment latch mechanism to secure the storage device to the fixed structure.
Figure 5A:
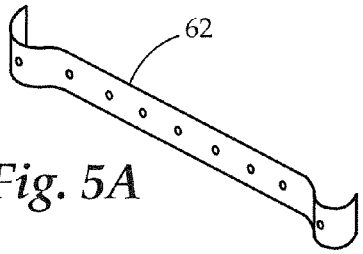
FIGS. 5A-5F illustrates various embodiments for optional attachment hangers to be utilized with the storage device.
Figure 5D:
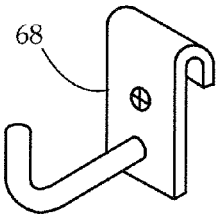
Figure 5E:
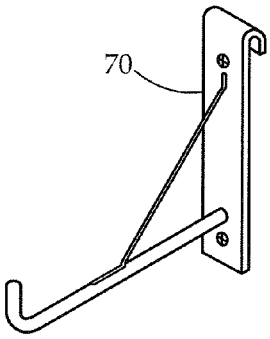
Figure 5B:
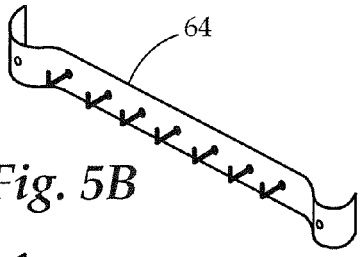
Figure 5C:
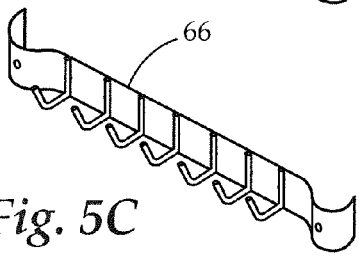
Figure 5F:
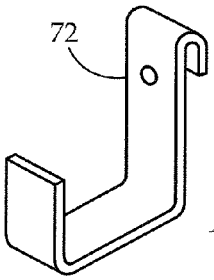
Figure 6A:
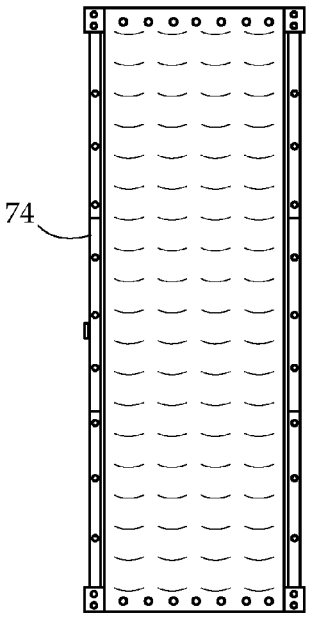
FIGS. 6A-6F illustrates various embodiments for optional attachment components to be utilized with the storage device.
Figure 6B:
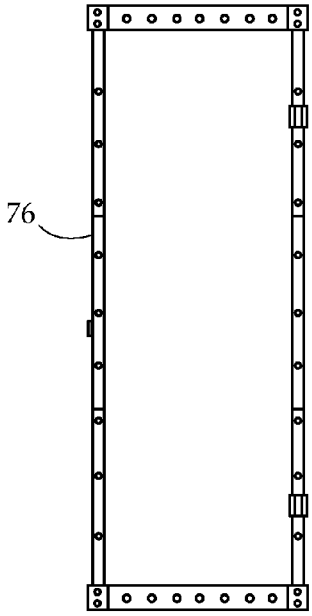
Figure 6C:
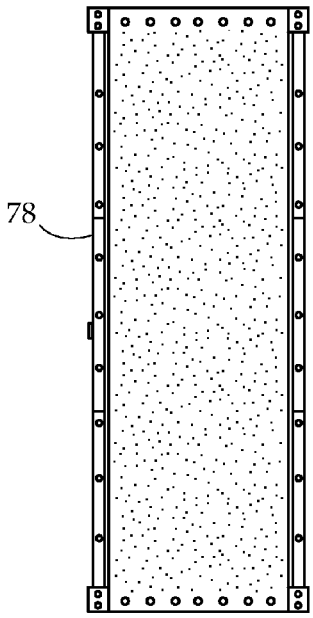
Figure 6D:
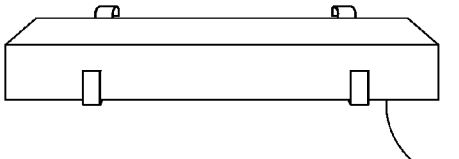
Figure 6E:
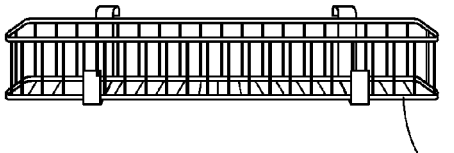
Figure 6F:
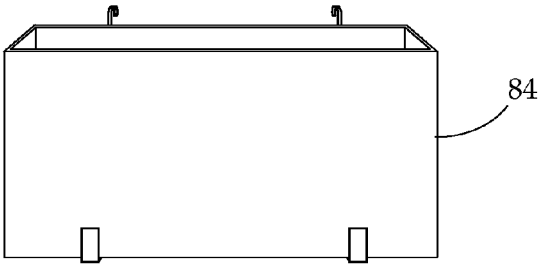

FIGS. 1A-2 illustrates a first embodiment of a hingedly adjustable two-sided storage device 10, wherein the storage device comprises a pair of lateral members 12A and 12B in communication with a top portion 14 and bottom portion 16. Preferably the pair of lateral members 12A and 12B is attached to the top portion 14 and bottom portion 16 of the storage device 10 through a plurality of corner joints 18. In one embodiment, each lateral member 12A and 12B, along with the top portion 14 and bottom portion 16 includes a plurality of apertures 20 preferably equidistantly spaced along each lateral member 12A and 12B, and the top portion 14 and bottom portion 16, disposed to receive a plurality of elements discussed below. In one alternate embodiment, the lateral elements 12A and 12B are comprised of a plurality of sections joined together, wherein the sections may be button joined or screwed together to increase and maintain stability throughout the entire lateral elements 12A and 12B. The storage device 10 further comprises a plurality of attachment mechanisms 22, wherein the attachment mechanisms 22 are disposed to secure the storage device 10 to a fixed structure 24, including but not limited to a door and a wall. Additionally, the storage device 10 may include a latch 26, wherein the latch 26 is disposed to be received by a corresponding ring 26B (see FIG. 4A) attached to the fixed structure 24. As such, the storage device 10 possesses both a front portion 30A and a back portion 30B to allow a user of the storage device 10 to utilize and access both portions for storage and other associated use. In one embodiment, the latch 26 allows for the storage device 10 to be secured in a "closed" position when not in use.

FIGS. 3A-3D illustrate two separate embodiments of the attachment mechanism 22 for the storage device 10, wherein the attachment mechanism 22 includes a cavity 32A disposed to be received by one of the lateral members 12A and 12B. The attachment mechanism 22 further includes a housing 34 extending outwardly from the cavity 32A, wherein the housing 34 is disposed to receive an arm 36, wherein one end of the arm 36 is allowed to move in and out of the housing 34 and wherein the other end of the arm 36 extends downwardly to secure contact with the fixed structure 24. In both embodiments, the housing 34 includes a holding mechanism 38, wherein the holding mechanism 38 corresponds with a plurality of pin holes 40 located on the arm 36 such that the holding mechanism 38 is allowed to be received through an aperture 42 located within the housing 34 and a corresponding pin hole 40 on the arm 36 to allow for an adjustable distance between one of the lateral elements 12A and 12B and the fixed structure 24. In the embodiment disclosed in FIG. 3A, the arm 36 further includes an end hinge 90 (shown in FIG. 3B) extending horizontally and secured to the fixed structure 24. In an alternate embodiment of the attachment mechanism shown in FIG. 3D, the arm 36 further includes a pin 44 extending downwardly from the arm 36 to be received in a corresponding cavity 46 secured to the fixed structure 24. The cavity 46 secured to the fixed structure 24 further includes a liner 48 disposed to allow for the pin 44 to move freely while simultaneously reducing the noise that would be associated with movement of the attachment mechanism 22.

FIGS. 4A-4H illustrate several embodiments of the latch 26; all embodiments of the latch 26 are secured to the lateral elements 12A and/or 12B using a filler 62 having an adhesive side facing towards the lateral elements 12A and 12B, and a polished side facing the latch 26, thereby allowing the latch 26 to move freely up and down. Furthermore, all embodiments of the latch 26 are secured to the fixed structure 24 by a ring 26B. The latch 26 further comprises a latch arm housing 56 and a latch sleeve 26A which extends outwardly from the latch arm housing 56 to receive the ring 26B. The latch arm housing 56 includes a holding mechanism 58, wherein the holding mechanism 58 corresponds with a plurality of pin holes 60 located on the latch sleeve 26A such that a holding mechanism 58 is allowed to be received through an aperture 42 (see FIG. 3C) located within the latch arm housing 56 and a corresponding pin hole 60 on the latch sleeve 26A to allow for an adjustable distance and to be secure between one of the lateral elements 12A and 12B and the fixed structure 24. In the embodiment shown in FIG. 4C, the latch sleeve 26A includes a plurality of ratchet mechanisms 86 wherein the ratchet mechanisms 86 correspond with the holding mechanism 58 (see FIG. 4D), such that a sliding member 88 which is affixed to the latch sleeve 26A and passed through and held by a cutout 87 in the latch arm housing 56 which allows for an adjustable distance between one of the lateral elements 12A and 12B and the fixed structure 24.

FIGS. 4E-4H illustrate an alternate embodiment of the latch 26, wherein a button 94 is disposed to be attached to a spring section 96A to allow for an adjustable distance between the latch sleeve 26A and the fixed structure 24 such that the button 94 is received in a corresponding pin hole 96B in the latch arm housing 56. In yet another alternate embodiment (see FIG. 4H) of the latch 26, the latch 26 includes a threaded screw 90, wherein one end is disposed to be received in a housing 92.

FIGS. 5A-5F illustrates a variety of optional attachment hangers for use and attachment to the storage device 10. In one embodiment, a hanger 62 is secured to apertures 20 on the lateral elements 12A and 12B, and includes a plurality of apertures to receive a plurality of items, including hanger embodiments 68, 70 and 72. Furthermore, alternate embodiment hangers 62, 64 and 66 are preferably curved inward to approximately one half of the lateral elements 12A and 12B to maximize available space ordinarily lost to frame laterals. In yet another alternate embodiment, hangers 62, 64, 66, 68, 70 and 72 may be utilized to secure items including, but not limited to belts, ties, clothing and towels. Finally, an alternate embodiment hanger 72 is preferably utilized as a support unit, but is not limited for use with attachment components 80, 82, and 84.

FIGS. 6A-6F illustrates a variety of optional attachment components for use and attachment to the storage device 10 preferably in conjunction with one or more of the hangers 62, 64, 66, 68, 70 and 72 mentioned above. In one embodiment, a variety of components 74, 76, 78, 80, 82, 84 are shown, including but not limited in size or function to a mirror, curtain (to shield items located on both sides), shoe storage, containers and a clothes hamper.

In operation, a user of the storage device 10 may first remove the hook 26A from the fixed structure 24 to switch the storage device 10 from a "closed" position to an "open" position, thereby allowing for a user to access both the front portion 30A and back portion 30B of the device 10. Furthermore, a user of the storage device 10 possesses the ability to configure the storage device 10 to a user's own needs by adding a variety of storage components and/or hangers to the storage device 10 or as demand warrants.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A storage device comprising:

a top portion;

a bottom portion;

a pair of lateral elements, wherein the lateral elements are connected to the top and bottom portions through a plurality of corner joints;

a plurality of apertures, wherein the plurality of apertures are equidistantly disposed along the pair of lateral elements and the top and bottom portions;

a plurality of attachment mechanisms, wherein the attachment mechanisms are located on one of the lateral elements to secure the storage device to a fixed structure; and wherein each attachment mechanism further comprises:

a cavity, wherein the cavity is disposed to receive the one of the lateral elements;

a housing, wherein the housing extends outwardly from the cavity and forms a tube;

an arm, wherein the arm is disposed to be received within the tube and, wherein the arm extends downwardly to secure with the fixed structure;

a housing aperture, wherein the housing aperture is located within the tube;

a plurality of pin holes, wherein the pin holes are located within the arm, such that a holding mechanism is received through the housing aperture in the housing and one of the pin holes on the arm to allow for an adjustable length between the one of the lateral elements and the fixed structure; and a latch, wherein the latch is located on the lateral element not possessing the plurality of attachment mechanisms to secure the storage device to the fixed structure.

2. The storage device of claim 1, wherein the arm further includes a pin extending downwardly from the arm to be receiving in a corresponding cavity secured to the fixed structure.

3. The storage device of claim 2, wherein the corresponding cavity further includes a liner disposed to allow for the pin to move freely while simultaneously reducing noise.

4. The storage device of claim 1, wherein the latch further comprises:

a latch arm housing;

a latch sleeve, wherein the latch sleeve extends outwardly from the latch arm housing to secure the storage device to the fixed structure;

a latch aperture, wherein the latch aperture is located within the latch arm housing; and a plurality of latch pin holes, wherein the latch pin holes are located within the latch sleeve, such that a latch holding mechanism is received through the latch aperture in the latch arm housing and one of the latch pin holes on the latch to allow for an adjustable length between the lateral element not possessing the plurality of attachment mechanisms and the fixed structure.

5. The storage device of claim 4, wherein the latch is secured to the lateral element not possessing the plurality of attachment mechanisms by a filler having an adhesive side facing towards the lateral element not possessing the plurality of attachment mechanisms and a polished side facing the latch.

6. The storage device of claim 4, wherein the latch is secured to the fixed structure through a ring.

7. The storage device of claim 1, wherein the storage device further comprises a front portion and a back portion.

8. The storage device of claim 1, wherein the latch is disposed to be received by a corresponding loop secured to the fixed structure.

9. The storage device of claim 1, wherein the fixed structure is selected from the group consisting of a door and a wall.

10. The storage device of claim 1, wherein the storage device is disposed to receive a plurality of attachment hangers for securing items selected from the group consisting of shoes, clothing, belts, ties and towels.

11. The storage device of claim 1, wherein the storage device is disposed to receive a plurality of attachment components selected from the group consisting of a mirror, curtain, shoe storage, containers and clothes hamper.

12. A storage device comprising:

a top portion;

a bottom portion;

a pair of lateral elements, wherein the lateral elements are connected to the top and bottom portions through a plurality of corner joints;

a plurality of apertures, wherein the plurality of apertures are equidistantly disposed along the pair of lateral elements and the top and bottom portions;

a plurality of attachment mechanisms, wherein the attachment mechanisms are located on one of the lateral elements to secure the storage device to a fixed structure, wherein each attachment mechanism further comprises:

a cavity, wherein the cavity is disposed to receive one of the lateral elements;

a housing, wherein the housing extends outwardly from the cavity and defines a tube;

an arm, wherein the arm is disposed to be received within the tube and extends downwardly to secure with the fixed structure;

a housing aperture, wherein the housing aperture is located within the tube; and a plurality of pin holes, wherein the pin holes are located within the arm, such that a holding mechanism is received through the housing aperture in the housing and one of the pin holes on the arm to allow for an adjustable length between the one of the lateral elements and the fixed structure; and a latch, wherein the latch is located on the lateral element not possessing the plurality of attachment mechanisms to secure the storage device to the fixed structure, wherein the latch further comprises:

a latch arm housing;

a latch sleeve, wherein the latch sleeve extends outwardly from the latch arm housing to secure the storage device to the fixed structure;

a latch aperture, wherein the latch aperture is located within the latch arm housing; and a plurality of latch pin holes, wherein the latch pin holes are located within the latch sleeve, such that a latch holding mechanism is received through the latch aperture in the latch arm housing and one of the latch pin holes on the latch sleeve to allow for an adjustable length between the lateral element not possessing the plurality of attachment mechanisms and the fixed structure.

* * * * *